US009829812B2

(12) United States Patent
Kusano et al.

(10) Patent No.: US 9,829,812 B2
(45) Date of Patent: Nov. 28, 2017

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Keisuke Kusano, Kanagawa (JP); Masahiro Iwasaki, Kanagawa (JP); Jiro Korenaga, Kanagawa (JP); Yukimi Kawabata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/217,203

(22) Filed: Jul. 22, 2016

(65) Prior Publication Data

US 2017/0261872 A1 Sep. 14, 2017

(30) Foreign Application Priority Data

Mar. 10, 2016 (JP) ..... 2016-047252

(51) Int. Cl.

| | |
|---|---|
| ***G03G 5/00*** | (2006.01) |
| ***G03G 5/06*** | (2006.01) |
| ***G03G 15/00*** | (2006.01) |
| ***G03G 5/07*** | (2006.01) |
| ***G03G 5/04*** | (2006.01) |

(52) U.S. Cl.

CPC ..... *G03G 5/0696* (2013.01); *G03G 5/04* (2013.01); *G03G 5/0612* (2013.01); *G03G 5/0614* (2013.01); *G03G 5/0618* (2013.01); *G03G 5/07* (2013.01); *G03G 15/75* (2013.01)

(58) Field of Classification Search

CPC ..... G03G 5/07; G03G 5/04; G03G 5/0612

See application file for complete search history.

(56) References Cited

FOREIGN PATENT DOCUMENTS

| | | |
|---|---|---|
| JP | 5-265232 A | 10/1993 |
| JP | 3218663 B2 | 10/2001 |
| JP | 3246680 B2 | 1/2002 |
| JP | 3289050 B2 | 6/2002 |

*Primary Examiner* — Mark A Chapman

(74) *Attorney, Agent, or Firm* — Sughrue Mion, PLLC

(57) ABSTRACT

An electrophotographic photoreceptor includes a conductive substrate and a single-layer-type photosensitive layer on the conductive substrate. The single-layer-type photosensitive layer contains a binder resin, a charge generating material, an electron transporting material, and a hole transporting material. The single-layer-type photosensitive layer has a concentration ratio (A/B) of 0.7 or more and 1.0 or less, where the concentration ratio (A/B) is a ratio of a concentration A of the electron transporting material relative to the binder resin measured from a surface of the photosensitive layer remote from the conductive substrate to a concentration B of the electron transporting material relative to the binder resin measured from a surface of the photosensitive layer close to the conductive substrate.

10 Claims, 3 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-047252 filed Mar. 10, 2016.

BACKGROUND

Technical Field

The present invention relates to an electrophotographic photoreceptor, a process cartridge, and an image forming apparatus.

SUMMARY

According to an aspect of the invention, there is provided an electrophotographic photoreceptor that includes a conductive substrate and a single-layer-type photosensitive layer on the conductive substrate. The single-layer-type photosensitive layer contains a binder resin, a charge generating material, an electron transporting material, and a hole transporting material. The single-layer-type photosensitive layer has a concentration ratio (A/B) of 0.7 or more and 1.0 or less or about 0.7 or more and about 1.0 or less, where the concentration ratio (A/B) is a ratio of a concentration A of the electron transporting material relative to the binder resin measured from a surface of the photosensitive layer remote from the conductive substrate to a concentration B of the electron transporting material relative to the binder resin measured from a surface of the photosensitive layer close to the conductive substrate.

BRIEF DESCRIPTION OF THE DRAWINGS

Exemplary embodiments of the present invention will be described in detail based on the following figures, wherein.

DETAILED DESCRIPTION

Figure 1:
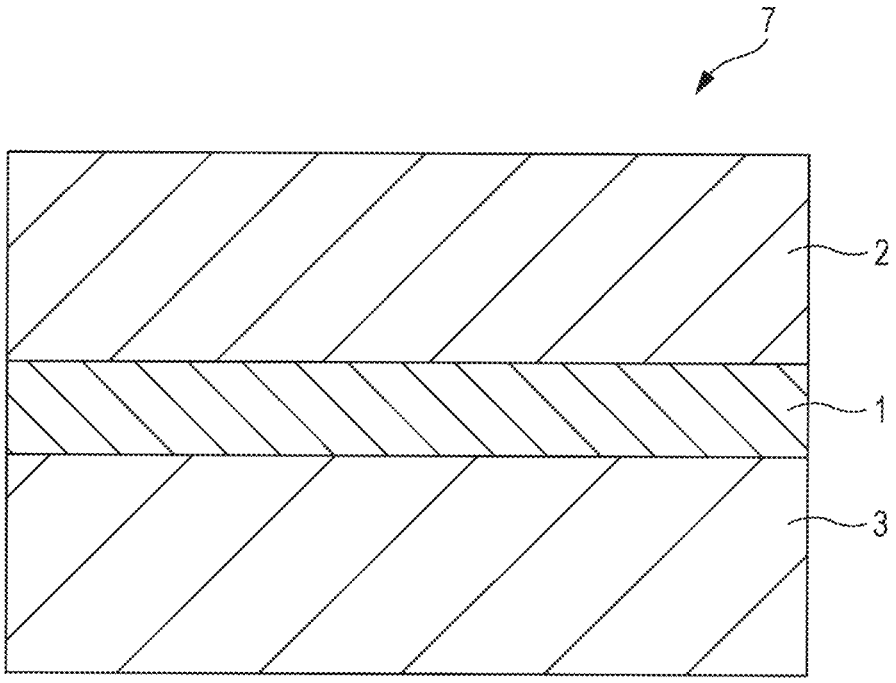
FIG. 1 is a schematic partial cross-sectional view of an electrophotographic photoreceptor according to an exemplary embodiment.

An exemplary embodiment which is one example of the present invention is described below.

Electrophotographic Photoreceptor

An electrophotographic photoreceptor according to an exemplary embodiment is a positively chargeable organic photoreceptor (hereinafter may be simply referred to as a "photoreceptor" or a "single-layer-type photoreceptor") that includes a conductive substrate and a single-layer-type photosensitive layer on the conductive substrate.

The single-layer-type photosensitive layer contains a binder resin, a charge generating material, an electron transporting material, and a hole transporting material. The ratio (A/B) of a concentration A to a concentration B (hereinafter may be simply referred to as the "concentration ratio (A/B)) is 0.7 or more and 1.0 or less or about 0.7 or more and about 1.0 or less, where the concentration A is the concentration of the electron transporting material relative to the binder resin measured from a surface of the photosensitive layer remote from the conductive substrate and the concentration B is the concentration of the electron transporting material relative to the binder resin measured from a surface of the photosensitive layer close to the conductive substrate.

A single-layer-type photosensitive layer is a photosensitive layer that has a charge generating capacity as well as a hole transporting property and an electron transporting property.

The photoreceptor of this exemplary embodiment having the above-described features suppresses occurrence of color spots when images are repeatedly formed in a high-temperature, high-humidity environment (for example, in an environment with a temperature of 28° C. and a relative humidity (RH) of 85%). The reason for this is presumably as follows.

A single-layer-type photoreceptor includes a single-layer-type photosensitive layer that contains a binder resin, a charge generating material, a hole transporting material, and an electron transporting material. Images repeatedly formed by the single-layer-type photoreceptor in a high-temperature, high-humidity environment (for example, in an environment with a temperature of 28° C. and a relative humidity (RH) of 85%) sometimes have color spots.

When the resistance (bulk resistance) of the single-layer-type photosensitive layer is high and the photosensitive layer is charged, local discharge occurs in a high-temperature, high-humidity environment and this results in charge leaking. A toner then adheres to the points (leak points) where the charges have leaked and presumably forms color spots.

A single-layer-type photosensitive layer is formed by using a coating solution for forming a photosensitive layer, and this coating solution contains the electron transporting material dissolved in the solvent. Thus, in the course of forming a photosensitive layer, a larger amount of the electron transporting material tends to be distributed to the conductive-substrate-side of the photosensitive layer due to thermal diffusion in the coating film formed by applying the coating solution for forming a photosensitive layer to the conductive substrate. In the course of forming the photosensitive layer, a portion of the photosensitive layer close to the conductive substrate is easily heated whereas a surface of a portion of the photosensitive layer remote from the conductive substrate (in other words, the surface of the photosensitive layer) dries slowly compared to the portion close to the conductive substrate. Thus, the electron transporting material in the surface portion of the photosensitive layer tends to migrate toward the conductive substrate. This phenomenon is more frequent when, for example, a fluorenone compound is used to increase the sensitivity of the photoreceptor. As a result, the surface of the photosensitive layer contains less electron transporting material and thus exhibits a degraded electron transporting capacity. This presumably increases the bulk resistance of the photosensitive layer as a whole, leading to formation of color spots.

In contrast, according to the photoreceptor of the exemplary embodiment, the thermal diffusion of the electron transporting material during the course of forming the single-layer-type photosensitive layer is controlled so that the ratio (A/B) of the concentration A of the electron transporting material relative to the binder resin measured from a surface of the photosensitive layer remote from the conductive substrate to the concentration B of the electron transporting material relative to the binder resin measured from a surface of the photosensitive layer close to the conductive substrate is 0.7 or more and 1.0 or less or about 0.7 or more and about 1.0 or less.

Under such an arrangement, the concentration of the electron transporting material in the portion close to the conductive substrate is decreased, the bulk resistance of the photosensitive layer as a whole is decreased, and the charge leaking is suppressed (leak resistance is improved). Thus, adhesion of spots of the toner to the photosensitive layer is suppressed and thus formation of color spots in a high-temperature, high-humidity environment is suppressed.

As discussed above, according to the photoreceptor of the exemplary embodiment, formation of color spots due to repeated image formation in a high-temperature, high-humidity environment (for example, an environment with a temperature of 28° C. and a relative humidity (RH) of 85%) is presumably suppressed.

The photoreceptor according to this exemplary embodiment tends to exhibit higher sensitivity when the single-layer-type photosensitive layer contains at least one charge generating material selected from a hydroxygallium phthalocyanine pigment and a chlorogallium phthalocyanine pigment, a hole transporting material represented by general formula (1), and an electron transporting material represented by general formula (2). In other words, when the single-layer-type photosensitive layer of the photoreceptor of the exemplary embodiment contains the charge generating material, the electron transporting material, and the hole transporting material described above, high sensitivity and suppression of formation of color spots in a high-temperature, high-humidity environment may both be achieved.

The electrophotographic photoreceptor according to the exemplary embodiment will now be described in detail with reference to the drawings.

FIG. 1 is a schematic cross-sectional view of a portion of an electrophotographic photoreceptor 7 according to the exemplary embodiment. The electrophotographic photoreceptor 7 illustrated in FIG. 1 includes, for example, a conductive substrate 3, and an undercoat layer 1 and a single-layer-type photosensitive layer 2 stacked on the conductive substrate 3 in this order.

The undercoat layer 1 is an optional layer. That is, the photosensitive layer may be directly formed on the conductive substrate 3 or on the undercoat layer 1 on the conductive substrate 3.

If needed, another layer may be formed. Specifically, for example, a protective layer may be formed on the single-layer-type photosensitive layer 2, if needed.

Each layer of the electrophotographic photoreceptor according to the exemplary embodiment will now be described in detail. In the description below, the reference numerals are omitted.

Conductive Substrate

Examples of the conductive substrate include metal plates, metal drums, and metal belts that contain metal (aluminum, copper, zinc, chromium, nickel, molybdenum, vanadium, indium, gold, platinum, or the like) or an alloy (stainless steel or the like). The conductive substrate may be a paper sheet or a resin film or belt covered with a conductive compound (for example, a conductive polymer or indium oxide), metal (for example, aluminum, palladium, or gold), or an alloy by coating, vapor deposition, or lamination, for example. The term "conductive" means that the volume resistivity is less than $10^{13}$ Ωcm.

When the electrophotographic photoreceptor is to be used in a laser printer, the surface of the conductive substrate may be roughened to a center-line-average roughness Ra of 0.04 μm or more and 0.5 μm or less in order to suppress interference fringes during laser beam irradiation. When an incoherent light is used as a light source, roughening for preventing interference fringes is not particularly needed but is desirable for a longer service life since defects caused by irregularities on the surface of the conductive substrate are suppressed.

Examples of the method for roughening include wet honing that involves spraying a suspension of an abrasive in water onto the conductive substrate, centerless grinding that involves continuously grinding the conductive substrate by pressing the conductive substrate against a rotating grinding stone, and anodization.

Another example of the roughening technique is to form a layer on the surface of the conductive substrate by using a dispersion of conductive or semi-conductive particles in a resin. In this manner, the surface of the conductive substrate is not subjected to roughening but roughening is still achieved by the particles dispersed in the layer on the conductive substrate.

Roughening through anodization involves conducting anodization by using a metal (e.g., aluminum) conductive substrate as the anode in an electrolytic solution so as to form an oxide film on the surface of the conductive substrate. Examples of the electrolytic solution include a sulfuric acid solution and an oxalic acid solution. However, the oxide film formed by anodization (anodized film) is porous, and is thus chemically active and susceptible to contamination as is. Moreover, the resistance thereof fluctuates depending on the environment. Thus the porous anodized film may be subjected to a pore stopping treatment with which the fine pores of the oxide film are stopped by volume expansion caused by hydration reaction with compressed steam or boiling water (a metal salt such as a nickel salt may be added) so as to convert the oxide into a more stable hydrous oxide.

The thickness of the anodized film may be, for example, 0.3 μm or more and 15 μm or less. When the thickness is in this range, the anodized film tends to exhibit a barrier property against injection and the increase in residual potential due to repeated use tends to be suppressed.

The conductive substrate may be treated with an acidic treatment solution or subjected to a Boehmite treatment.

The treatment with an acidic treatment solution is, for example, carried out as follows. First, an acidic treatment solution containing phosphoric acid, chromic acid, and hydrofluoric acid is prepared. The blend ratios of phosphoric acid, chromic acid, and hydrofluoric acid in the acidic treatment solution are, for example, phosphoric acid: 10% by weight or more and 11% by weight or less, chromic acid: 3% by weight or more and 5% by weight or less, and hydrofluoric acid: 0.5% by weight or more and 2% by weight or less. The total acid concentration may be 13.5% by weight or more and 18% by weight or less. The treatment temperature may be, for example, 42° C. or higher and 48° C. or lower. The thickness of the coating film may be 0.3 μm or more and 15 μm or less.

The Boehmite treatment is conducted, for example, by immersing the conductive substrate in pure water at 90° C. or higher and 100° C. or lower for 5 minutes to 60 minutes or bringing the conductive substrate into contact with compressed steam at 90° C. or higher and 120° C. or lower for 5 minutes to 60 minutes. The thickness of the film may be 0.1 μm or more and 5 μm or less. The resulting conductive substrate may be further subjected to an anodization treatment by using an electrolytic solution that has a low film dissolving power, such as adipic acid, boric acid, borate, phosphate, phthalate, maleate, benzoate, tartrate, or citrate.

Undercoat Layer

The undercoat layer is, for example, a layer that contains inorganic particles and a binder resin.

Examples of the inorganic particles are those having a powder resistance (volume resistivity) of $10^2$ Ωcm or more and $10^{11}$ Ωm or less.

Examples of the inorganic particles having such resistivity include metal oxide particles such as tin oxide particles, titanium oxide particles, zinc oxide particles, and zirconium oxide particles. Zinc oxide particles may be used as the inorganic particles.

The BET specific surface area of the inorganic particles may be, for example, 10 $m^2/g$ or more. The volume-average particle diameter of the inorganic particles may be, for example, 50 nm or more and 2000 nm or less (preferably 60 nm or more and 1000 nm or less).

The inorganic particle content relative to, for example, the binder resin may be 10% by weight or more and 80% by weight or less or may be 40% by weight or more and 80% by weight or less.

The inorganic particles may be surface treated. A mixture of two or more types of inorganic particles subjected different surface treatments or having different particle diameters may be used.

Examples of the surface treatment agent include a silane coupling agent, a titanate coupling agent, an aluminum coupling agent, and a surfactant. In particular, a silane coupling agent or, to be more specific, a silane coupling agent having an amino group may be used.

Examples of the silane coupling agent having an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in combination. For example, a combination of a silane coupling agent having an amino group and another silane coupling agent may be used. Examples of this another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method using the surface treatment agent may be any known method and may be a wet method or a dry method.

The amount of the surface treatment agent used may be 0.5% by weight or more and 10% by weight or less relative to the inorganic particles.

The undercoat layer may contain an electron accepting compound (acceptor compound) as well as inorganic particles. This is because long-term stability of electric properties and the carrier blocking property are enhanced.

Examples of the electron accepting compounds include electron transporting substances such as quinone-based compounds such as chloranil and bromanil; tetracyanoquinodimethane-based compounds; fluorenone compounds such as 2,4,7-trinitrofluorenone and 2,4,5,7-tetranitro-9-fluorenone; oxadiazole-based compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone-based compounds; thiophene compounds; and diphenoquinone compounds such as 3,3',5,5'-tetra-t-butyldiphenoquinone.

A compound having an anthraquinone structure may be used as the electron-accepting compound. Examples of the compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

The electron accepting compound may be co-dispersed with the inorganic particles in the undercoat layer. Alternatively, the electron accepting compound may be attached to the surfaces of the inorganic particles and contained in the undercoat layer.

A method for causing the electron accepting compound to attach to the surfaces of the inorganic particles may be a dry method or a wet method.

According to a dry method, for example, while inorganic particles are stirred with a mixer or the like having a large shear force, an electron accepting compound as is or dissolved in an organic solvent is dropped or sprayed along with dry air or nitrogen gas so as to cause the electron accepting compound to attach to the surfaces of the inorganic particles. When the electron accepting compound is dropped or sprayed, the temperature may be not higher than the boiling point of the solvent. After the electron accepting compound is dropped or sprayed, baking may be further conducted at 100° C. or higher. Baking may be conducted at any temperature for any amount of time as long as electrophotographic properties are obtained.

According to a wet method, while inorganic particles are dispersed in a solvent through stirring or by using ultrasonic waves, a sand mill, an attritor, a ball mill, or the like, an electron accepting compound is added thereto and the resulting mixture is stirred or dispersed, followed by removal of the solvent to cause the electron accepting compound to attach to the surfaces of the inorganic particles. The solvent is removed by, for example, filtration or distillation. After removal of the solvent, baking may be conducted at 100° C. or higher. Baking may be conducted at any temperature for any amount of time as long as electrophotographic properties are obtained. In the wet method, the water contained in the inorganic particles may be removed prior to adding the electron accepting compound. For example, water may be removed by stirring the inorganic compound in a solvent under heating or azeotropically with the solvent.

The electron accepting compound may be attached to the inorganic particles before, after, or at the same time as the surface treatment with a surface treatment agent.

The electron accepting compound content relative to, for example, the inorganic particles may be 0.01% by weight or more and 20% by weight or less or 0.01% by weight or more and 10% by weight or less.

Examples of the binder resin used in the undercoat layer include known polymer materials such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; and other known materials such as zirconium chelate compounds, titanium chelate compounds, aluminum chelate compounds, titanium alkoxide compounds, organic titanium compounds, and silane coupling agents. Other examples of the binder resin used in the undercoat layer include charge transporting resins having charge transporting groups and conductive resins (for example, polyaniline).

Among these, a resin insoluble in the coating solvent contained in the overlying layer may be used as the binder resin contained in the undercoat layer. Examples thereof include thermosetting resins such as urea resins, phenolic resins, phenol-formaldehyde resins, melamine resins, urethane resins, unsaturated polyester resins, alkyd resins, and epoxy resins; and resins obtained by reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin. When two or more of these binder resins are used in combination, the mixing ratio is set as desired.

The undercoat layer may contain various additives that improve electrical properties, environmental stability, and image quality. Examples of the additives include known materials such as electron transporting pigments based on fused polycyclic and azo materials, zirconium chelate compounds, titanium chelate compounds, aluminum chelate compounds, titanium alkoxide compounds, organic titanium compounds, and silane coupling agents. Although a silane coupling agent is used in a surface treatment of inorganic particles as discussed above, it may also be added to the undercoat layer as an additive.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compound include zirconium butoxide, zirconium ethyl acetoacetate, zirconium triethanolamine, zirconium acetylacetonate butoxide, zirconium ethyl acetoacetate butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butylate, diethylacetoacetate aluminum diisopropylate, and aluminum tris(ethyl acetoacetate).

These additives may be used alone or as a mixture or a polycondensation product of two or more compounds.

The undercoat layer may have a Vickers hardness of 35 or more.

The surface roughness (ten-point average roughness) of the undercoat layer may be adjusted to 1/(4n) (n: refractive index of overlying layer) to ½ of the exposure laser wavelength λ in order to suppress moire images.

Resin particles and the like may be added to the undercoat layer to adjust the surface roughness. Examples of the resin particles include silicone resin particles and crosslinked polymethyl methacrylate resin particles. The surface of the undercoat layer may be polished to adjust the surface roughness. Examples of the polishing method include buff polishing, sand blasting, wet honing, and grinding.

The undercoat layer may be formed by any known method. For example, a coating solution for forming an undercoat layer may be prepared by adding the above-described components to a solvent, forming a coating film by using this coating solution, drying the coating film, and, if needed, heating the coating film.

Examples of the solvent used to prepare the coating solution for forming an undercoat layer include known organic solvents such as alcohol solvents, aromatic hydrocarbon solvents, halogenated hydrocarbon solvents, ketone solvents, ketone alcohol solvents, ether solvents, and ester solvents.

Specific examples of these solvents include ordinary organic solvents such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the technique for dispersing inorganic particles in preparing the coating solution for forming an undercoat layer include known techniques that use a roll mill, a ball mill, a vibrating ball mill, an attritor, a sand mill, a colloid mill, and a paint shaker.

Examples of the technique for applying the coating solution for forming an undercoat layer onto the conductive substrate include known techniques such as a blade coating technique, a wire bar coating technique, a spray coating technique, a dip coating technique, a bead coating technique, an air knife coating technique, and a curtain coating technique.

The thickness of the undercoat layer may be set to 15 μm or more or 20 μm or more, and 50 μm or less.

Intermediate Layer

An intermediate layer may be formed between the undercoat layer and the photosensitive layer although this is not illustrated in the drawings.

The intermediate layer is, for example, a layer that contains a resin. Examples of the resin contained in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organic metal compound. Examples of the organic metal compound contained in the intermediate layer include organic metal compounds containing metal atoms such as zirconium, titanium, aluminum, manganese, and silicon atoms.

These compounds to be contained in the intermediate layer may be used alone or as a mixture or a polycondensation product of two or more compounds.

The intermediate layer may be a layer that contains an organic compound that contains a zirconium atom or a silicon atom, in particular.

The intermediate layer may be formed by any known method. For example, a coating solution for forming the intermediate layer may be prepared by adding the above-described components to a solvent and applied to form a coating film, and the coating film may be dried and, if desired, heated. Examples of the technique for applying the solution for forming the intermediate layer include known techniques such as a dip coating technique, a lift coating technique, a wire bar coating technique, a spray coating technique, a blade coating technique, a knife coating technique, and a curtain coating technique.

The thickness of the intermediate layer is, for example, set within the range of 0.1 μm or more and 3 μm or less. The intermediate layer may serve as an undercoat layer.

Single-Layer-Type Photosensitive Layer

The single-layer-type photosensitive layer contains a binder resin, a charge generating material, an electron transporting material, and a hole transporting material. The single-layer-type photosensitive layer may further contain other additives if needed.

In this exemplary embodiment, the single-layer-type photosensitive layer has a concentration ratio (A/B) of 0.7 or more and 1.0 or less or about 0.7 or more and about 1.0 or less, where the concentration ratio (A/B) is the ratio of the concentration A of the electron transporting material relative to the binder resin measured from a surface of the photosensitive layer remote from the conductive substrate, to the concentration B of the electron transporting material relative to the binder resin measured from a surface of the photosensitive layer close to the conductive substrate.

The concentration ratio (A/B) is determined as follows. In spectrum obtained by attenuated total reflection infrared spectroscopy from a surface close to the conductive substrate and a surface remote from the conductive substrate, a peak area $SA_b$ of the peak derived from the binder resin and a peak area $SA_{ETM}$ of the peak derived from the electron transporting material are measured. From the measurement results, the concentration of the electron transporting material relative to the binder resin, i.e., $SA_{ETM}/SA_b$, is calculated and the concentration A of the electron transporting material relative to the binder resin measured from the surface remote from the conductive substrate is determined. In the same manner, in the spectrum obtained by attenuated total reflection infrared spectroscopy measured at the surface close to the conductive substrate, the peak area $SB_b$ of the peak derived from the binder resin and the peak area $SB_{ETM}$ of the peak derived from the electron transporting material are measured. From the measurement results, the concentration of the electron transporting material relative to the binder resin, i.e., $SB_{ETM}/SB_b$, is calculated, and the concentration B of the electron transporting material relative to the binder resin measured from the surface close to the conductive substrate is determined. Then the obtained concentration A and concentration B are used to determine the concentration ratio (A/B).

For example, when a bisphenol Z polycarbonate resin is used as a binder resin, the peak area between 1815 $cm^{-1}$ and 1740 $cm^{-1}$ (1815 $cm^{-1}$ and 1740 $cm^{-1}$ are inclusive) is assumed to be the peak area of the peak derived from the binder resin. When an electron transporting material represented by general formula (2) is used as the electron transporting material, the peak area between 1740 $cm^{-1}$ and 1700 $cm^{-1}$ (1740 $cm^{-1}$ and 1700 $cm^{-1}$ are inclusive) is assumed to be the peak area of the peak derived from the electron transporting material.

Specifically, a photosensitive layer is stripped away from the photoreceptor to be measured so as to prepare a measurement sample. A surface of the measurement sample remote from the conductive substrate is analyzed with an attenuated total reflection infrared spectrometer (FTIR Spotlight 400, produced by Perkin Elmer; internal reflective element (prism): Ge (germanium), incident angle: 45°) and the concentration A is obtained by the method described above. The same measurement is conducted on a surface of the measurement sample close to the conductive substrate and the concentration B is obtained by the method described above. Then the concentration ratio (A/B) is calculated.

The region between the surface of the photosensitive layer remote from the conductive substrate and the surface of the photosensitive layer close to the conductive substrate (for example, the region at a depth of ½ of the thickness of the photosensitive layer from the surface) may have an electron transporting material concentration C relative to the binder resin that comes between the concentration A and the concentration B. The concentration C is determined as follows.

First, the photosensitive layer is stripped away from the photoreceptor to be measured and embedded. The embedded sample is cut with a microtome in a direction oblique with respect to the interface between the conductive substrate and the photosensitive layer (a direction oblique with respect to a perpendicular direction that extends from the outer peripheral surface of the conductive substrate to the surface of the photosensitive layer) so as to obtain a measurement sample with an enlarged measurement section whose measurement surface is the cross section taken in the thickness direction of the photosensitive layer. This measurement sample is analyzed with an attenuated total reflection infrared spectrometer (FTIR Spotlight 400, produced by Perkin Elmer; internal reflective element (prism): Ge (germanium), incident angle: 45°) to obtain a spectrum at a predetermined position in the thickness direction of the photosensitive layer (for example, the position ½ of the thickness from the surface toward the conductive substrate). In this spectrum, the peak area $SC_b$ of the peak derived from the binder resin and the peak area $SC_{ETM}$ of the peak derived from the electron transporting material are measured. From the measurement results, the concentration of the electron transporting material relative to the binder resin, i.e., $SC_{ETM}/SC_b$, is calculated and the concentration C of the electron transporting material relative to the binder resin is determined.

Binder Resin

The binder resin may be any binder resin. Examples thereof include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazole, and polysilane. These binder resins may be used alone or in combination.

Among these binder resins, polycarbonate resins having a viscosity-average molecular weight of 30,000 or more and 80,00 or less may be used from the viewpoint of the film forming property of the photosensitive layer.

To facilitate control of the concentration ratio (A/B) to be in the range of 0.7 to 1.0, a polycarbonate resin having a viscosity-average molecular weight of 45,000 or more and 60,000 or less may be used, for example.

The viscosity-average molecular weight of the polycarbonate resin is measured as follows, for example. In 100 $cm^3$ of methylene chloride, 1 g of the resin is dissolved. The specific viscosity ηsp of the resulting solution is measured with a Ubbelohde viscometer in a 25° C. measurement environment. Then the limiting viscosity [η] ($cm^3/g$) is determined from the expression $\eta sp/c=[\eta]+0.45\ [\eta]^2c$ (where c represents the concentration ($g/cm^3$)), and the viscosity-average molecular weight My is determined from the expression given by H. Schnell, $[\eta]=1.23\times10^{-4}\ Mv^{0.83}$.

The binder resin content relative to the total solid content of the photosensitive layer may be 35% by weight or more and 60% by weight or less or about 35% by weight or more and about 60% by weight or less, or may be 20% by weight or more and 35% by weight or less or about 20% by weight or more and about 35% by weight or less.

Charge Generating Material

The charge generating material may be any charge generating material. Examples thereof include hydroxygallium phthalocyanine pigments, chlorogallium phthalocyanine pigments, titanyl phthalocyanine pigments, and metal-free phthalocyanine pigments. These charge generating materials may be used alone or in combination. Among these, a hydroxygallium phthalocyanine pigment, in particular, a V-type hydroxygallium phthalocyanine pigment, may be used to increase the sensitivity of the photoreceptor.

A hydroxygallium phthalocyanine pigment having a maximum peak wavelength in the range of 810 nm to 839 nm in an absorption spectrum in the range of 600 nm or more and 900 nm or less may be used as the hydroxygallium phthalocyanine pigment since a higher dispersibility is obtained. When it is used as a material for the electrophotographic photoreceptor, good dispersibility and sufficient sensibility, chargeability, and dark decay characteristics can be easily obtained.

The hydroxygallium phthalocyanine pigment having a maximum peak wavelength in the range of 810 nm to 839 nm may have an average particle diameter within a particular range and a BET specific surface area within a particular range. Specifically, the average particle diameter may be 0.20 μm or less, or in the range of 0.01 μm or more and 0.15 μm or less. The BET specific surface area may be 45 $m^2/g$ or more, 50 $m^2/g$ or more, or in the range of 55 $m^2/g$ or more and 120 $m^2/g$ or less. The average particle diameter is a volume-average particle diameter (d50 average particle diameter) measured with a laser diffraction scattering particle size distribution meter (LA-700, produced by Horiba Ltd.). The BET specific surface area is a value measured with a BET surface area analyzer (FlowSorb II2300 produced by Shimadzu Corporation) by a nitrogen substitution technique.

When the average particle diameter is larger than 0.20 μm or when the specific surface area is less than 45 $m^2/g$, the pigment particles may be coarse or the pigment particles may be aggregated. This may affect dispersibility and lead to defects in properties such as sensitivity, chargeability, and dark decay characteristics. As a result, image defects may occur.

The maximum particle diameter (maximum primary particle diameter) of the hydroxygallium phthalocyanine pigment may be 1.2 μm or less, 1.0 μm or less, or 0.3 μm or less. When the maximum particle diameter is beyond this range, black spots may occur.

In order to suppress density variation resulting from exposure of the photoreceptor to a fluorescent lamp, the hydroxygallium phthalocyanine pigment may have an average particle diameter of 0.2 μm or less, a maximum particle diameter of 1.2 μm or less, and a specific surface area of 45 $m^2/g$ or more.

The hydroxygallium phthalocyanine pigment may be of a V-type with which diffraction peaks are detected at Bragg's angles (2θ±0.2°) of at least 7.3°, 16.0°, 24.9°, and 28.0° in an X-ray diffraction spectrum taken with Cu Kα X-ray.

The chlorogallium phthalocyanine pigment may be any and may be a chlorogallium phthalocyanine pigment that has diffraction peaks at Bragg's angles (2θ±0.2°) of 7.4°, 16.6°, 25.5°, and 28.3° since the electrophotographic photoreceptor material exhibits good sensitivity.

The maximum peak wavelength of the absorption spectrum, the average particle diameter, the maximum particle diameter, and the specific surface area of the chlorogallium phthalocyanine pigment may be the same as those of the hydroxygallium phthalocyanine pigment.

The charge generating material content relative to the total solid content of the photosensitive layer is 1% by weight or more and 5% by weight or less and may be 1.2% by weight or more and 4.5% by weight or less.

Hole Transporting Material

The hole transporting material may be any hole transporting material. Examples thereof include oxadiazole derivatives such as 2,5-bis(p-diethylaminophenyl)-1,3,4-oxadiazole; pyrazoline derivatives such as 1,3,5-triphenylpyrazoline and 1-[pyridyl-(2)]-3-(p-diethylaminostyryl)-5-(p-diethylaminostyryl)pyrazoline; aromatic tertiary amino compounds such as triphenylamine, N,N'-bis(3,4-dimethylphenyl)biphenyl-4-amine, tri(p-methylphenyl)aminyl-4-amine, and dibenzylaniline; aromatic tertiary diamino compounds such as N,N'-bis(3-methylphenyl)-N,N'-diphenylbenzidine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenylhydrazone; quinazoline derivatives such as 2-phenyl-4-styryl-quinazoline; benzofuran derivatives such as 6-hydroxy-2,3-di(p-methoxyphenyl)benzofuran; α-stilbene derivatives such as p-(2,2-diphenylvinyl)-N,N-diphenylaniline; enamine derivatives, carbazole derivatives such as N-ethylcarbazole; poly-N-vinylcarbazole and its derivatives; and a polymer having a group containing any one of the above-described compounds in a main chain or a side chain. These hole transporting materials may be used alone or in combination.

Specific examples of the hole transporting material include compounds represented by general formulae (B-1) and (B-2) below and compounds represented by general formula (1) below. Among these, a hole transporting material represented by general formula (1) below may be used from the viewpoint of charge mobility.

(B-1)

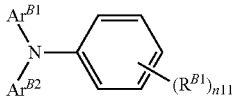

In general formula (B-1), $R^{B1}$ represents a hydrogen atom or a methyl group, n11 represents 1 or 2, and $Ar^{B1}$ and $Ar^{B2}$ each independently represent a substituted or unsubstituted aryl group, $—C_6H_4—C(R^{B3})=C(R^{B4})(R^{B5})$, or $—C_6H_4—CH=CH—CH=C(R^{B6})(R^{B7})$ where $R^{B3}$ to $R^{B7}$ each independently represent a hydrogen atom, a substituted or unsubstituted alkyl group, or a substituted or unsubstituted aryl group. Examples of the substituent include a halogen atom, an alkyl group having 1 to 5 carbon atoms, an alkoxy group having 1 to 5 carbon atoms, or a substituted amino group substituted with an alkyl group having 1 to 3 carbon atoms.

(B-2)

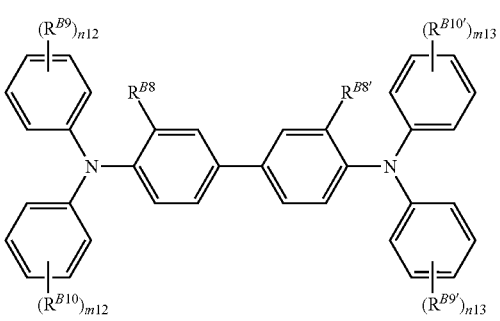

In general formula (B-2), $R^{B5}$ and $R^{B3'}$ may be the same or different and each independently represent a hydrogen atom, a halogen atom, an alkyl group having 1 to 5 carbon atoms, or an alkoxy group having 1 to 5 carbon atoms. $R^{B9}$, $R^{B9'}$, $R^{B10}$, and $R^{B10'}$ may be the same or different and each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, —C($R^{B11}$)═C($R^{B12}$)($R^{B13}$), or —CH═CH—CH═C($R^{B14}$)($R^{B15}$) where $R^{B11}$ to $R^{B15}$ each independently represent a hydrogen atom, a substituted or unsubstituted alkyl group, or a substituted or unsubstituted aryl group. Moreover, m12, m13, n12, and n13 each independently represent an integer of 0 or more and 2 or less.

Among the compounds represented by general formulae (B-1) and (B-2), preferable are a compound represented by general formula (B-1) having "—$C_6H_4$—CH═CH—CH═C($R^{B6}$)($R^{B7}$)" and a compound represented by general formula (B-2) having "—CH═CH—CH═C($R^{B14}$)($R^{B15}$)".

thereof include a methyl group, an ethyl group, an n-propyl group, an isopropyl group, an n-butyl group, and an isobutyl group.

Among these, a methyl group and an ethyl group are preferable as the lower alkyl group.

Examples of the alkoxy group represented by $R^1$ to $R^6$ in general formula (1) include alkoxy groups having 1 to 4 carbon atoms. Specific examples thereof include a methoxy group, an ethoxy group, a propoxy group, and a butoxy group.

Examples of the halogen atom represented by $R^1$ to $R^6$ in general formula (1) include a fluorine atom, a chlorine atom, a bromine atom, and an iodine atom.

Examples of the phenyl group represented by $R^1$ to $R^6$ in general formula (1) include an unsubstituted phenyl group; a phenyl group substituted with a lower alkyl group such as a p-tolyl group or a 2,4-dimethylphenyl group; a phenyl group substituted with a lower alkoxy group such as p-methoxyphenyl group; and a phenyl group substituted with halogen atoms such as a p-chlorophenyl group.

Examples of the substituents for the phenyl group include lower alkyl groups, lower alkoxy groups, and halogen atoms which are the same as those represented by $R^1$ to $R^6$.

Among the hole transporting materials represented by general formula (1), a hole transporting material with p and q both representing 1 is preferable from the viewpoint of increasing sensitivity and suppressing formation of color spots. A hole transporting material with $R^1$ to $R^6$ each independently representing a hydrogen atom, a lower alkyl group, or an alkoxy group and with p and q each representing 1 is more preferable.

Example Compounds of the hole transporting material represented by general formula (1) are as follows. These examples are not limiting. In describing the reference numeral of Example Compound, the compound is described as "Example Compound (1-number). For example, Example Compound 15 is referred to as "Example Compound (1-15)".

(1)

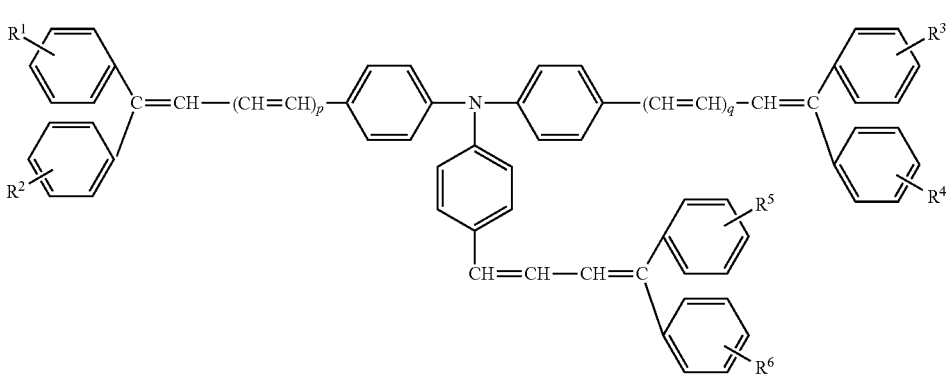

In general formula (1), $R^1$, $R^2$, $R^3$, $R^4$, $R^5$, and $R^6$ each independently represent a hydrogen atom, a lower alkyl group, an alkoxy group, a phenoxy group, a halogen atom, or a phenyl group which may have a substituent selected from a lower alkyl group, a lower alkoxy group, and a halogen atom. In the formula, p and q each independently represent 0 or 1.

Examples of the lower alkyl group represented by $R^1$ to $R^6$ in general formula (1) include linear or branched alkyl groups having 1 to 4 carbon atoms. Specific examples

| Example Compound | p | q | $R^1$ | $R^2$ | $R^3$ | $R^4$ | $R^5$ | $R^6$ |
|---|---|---|---|---|---|---|---|---|
| 1 | 1 | 1 | H | H | H | H | H | H |
| 2 | 1 | 1 | 4-Me | 4-Me | 4-Me | 4-Me | 4-Me | 4-Me |
| 3 | 1 | 1 | 4-Me | 4-Me | H | H | 4-Me | 4-Me |
| 4 | 1 | 1 | 4-Me | H | 4-Me | H | 4-Me | H |
| 5 | 1 | 1 | H | H | 4-Me | 4-Me | H | H |
| 6 | 1 | 1 | 3-Me | 3-Me | 3-Me | 3-Me | 3-Me | 3-Me |
| 7 | 1 | 1 | H | H | H | H | 4-Cl | 4-Cl |

-continued

| Example Compound | p | q | $R^1$ | $R^2$ | $R^3$ | $R^4$ | $R^5$ | $R^6$ |
|---|---|---|---|---|---|---|---|---|
| 8 | 1 | 1 | 4-MeO | H | 4-MeO | H | 4-MeO | H |
| 9 | 1 | 1 | H | H | H | H | 4-MeO | 4-MeO |
| 10 | 1 | 1 | 4-MeO | 4-MeO | 4-MeO | 4-MeO | 4-MeO | 4-MeO |
| 11 | 1 | 1 | 4-MeO | H | 4-MeO | H | 4-MeO | 4-MeO |
| 12 | 1 | 1 | 4-Me | H | 4-Me | H | 4-Me | 4-F |
| 13 | 1 | 1 | 3-Me | H | 3-Me | H | 3-Me | H |
| 14 | 1 | 1 | 4-Cl | H | 4-Cl | H | 4-Cl | H |
| 15 | 1 | 1 | 4-Cl | 4-Cl | 4-Cl | 4-Cl | 4-Cl | 4-Cl |
| 16 | 1 | 1 | 3-Me | 3-Me | 3-Me | 3-Me | 3-Me | 3-Me |
| 17 | 1 | 1 | 4-Me | 4-MeO | 4-Me | 4-MeO | 4-Me | 4-MeO |
| 18 | 1 | 1 | 3-Me | 4-MeO | 3-Me | 4-MeO | 3-Me | 4-MeO |
| 19 | 1 | 1 | 3-Me | 4-Cl | 3-Me | 4-Cl | 3-Me | 4-Cl |
| 20 | 1 | 1 | 4-Me | 4-Cl | 4-Me | 4-Cl | 4-Me | 4-Cl |
| 21 | 1 | 0 | H | H | H | H | H | H |
| 22 | 1 | 0 | 4-Me | 4-Me | 4-Me | 4-Me | 4-Me | 4-Me |
| 23 | 1 | 0 | 4-Me | 4-Me | H | H | 4-Me | 4-Me |
| 24 | 1 | 0 | H | H | 4-Me | 4-Me | H | H |
| 25 | 1 | 0 | H | H | 3-Me | 3-Me | H | H |
| 26 | 1 | 0 | H | H | 4-Cl | 4-Cl | H | H |
| 27 | 1 | 0 | 4-Me | H | H | H | 4-Me | H |
| 28 | 1 | 0 | 4-MeO | H | H | H | 4-MeO | H |
| 29 | 1 | 0 | H | H | 4-MeO | 4-MeO | H | H |
| 30 | 1 | 0 | 4-MeO | 4-MeO | 4-MeO | 4-MeO | 4-MeO | 4-MeO |
| 31 | 1 | 0 | 4-MeO | H | 4-MeO | H | 4-MeO | 4-MeO |
| 32 | 1 | 0 | 4-Me | H | 4-Me | H | 4-Me | 4-F |
| 33 | 1 | 0 | 3-Me | H | 3-Me | H | 3-Me | H |
| 34 | 1 | 0 | 4-Cl | H | 4-Cl | H | 4-Cl | H |
| 35 | 1 | 0 | 4-Cl | 4-Cl | 4-Cl | 4-Cl | 4-Cl | 4-Cl |
| 36 | 1 | 0 | 3-Me | 3-Me | 3-Me | 3-Me | 3-Me | 3-Me |
| 37 | 1 | 0 | 4-Me | 4-MeO | 4-Me | 4-MeO | 4-Me | 4-MeO |
| 38 | 1 | 0 | 3-Me | 4-MeO | 3-Me | 4-MeO | 3-Me | 4-MeO |
| 39 | 1 | 0 | 3-Me | 4-Cl | 3-Me | 4-Cl | 3-Me | 4-Cl |
| 40 | 1 | 0 | 4-Me | 4-Cl | 4-Me | 4-Cl | 4-Me | 4-Cl |
| 41 | 0 | 0 | H | H | H | H | H | H |
| 42 | 0 | 0 | 4-Me | 4-Me | 4-Me | 4-Me | 4-Me | 4-Me |
| 43 | 0 | 0 | 4-Me | 4-Me | 4-Me | 4-Me | H | H |
| 44 | 0 | 0 | 4-Me | H | 4-Me | H | H | H |
| 45 | 0 | 0 | H | H | H | H | 4-Me | 4-Me |
| 46 | 0 | 0 | 3-Me | 3-Me | 3-Me | 3-Me | H | H |
| 47 | 0 | 0 | H | H | H | H | 4-Cl | 4-Cl |
| 48 | 0 | 0 | 4-MeO | H | 4-MeO | H | H | H |
| 49 | 0 | 0 | H | H | H | H | 4-MeO | 4-MeO |
| 50 | 0 | 0 | 4-MeO | 4-MeO | 4-MeO | 4-MeO | 4-MeO | 4-MeO |
| 51 | 0 | 0 | 4-MeO | H | 4-MeO | H | 4-MeO | 4-MeO |
| 52 | 0 | 0 | 4-Me | H | 4-Me | H | 4-Me | 4-F |
| 53 | 0 | 0 | 3-Me | H | 3-Me | H | 3-Me | H |
| 54 | 0 | 0 | 4-Cl | H | 4-Cl | H | 4-Cl | H |
| 55 | 0 | 0 | 4-Cl | 4-Cl | 4-Cl | 4-Cl | 4-Cl | 4-Cl |
| 56 | 0 | 0 | 3-Me | 3-Me | 3-Me | 3-Me | 3-Me | 3-Me |
| 57 | 0 | 0 | 4-Me | 4-MeO | 4-Me | 4-MeO | 4-Me | 4-MeO |
| 58 | 0 | 0 | 3-Me | 4-MeO | 3-Me | 4-MeO | 3-Me | 4-MeO |
| 59 | 0 | 0 | 3-Me | 4-Cl | 3-Me | 4-Cl | 3-Me | 4-Cl |
| 60 | 0 | 0 | 4-Me | 4-Cl | 4-Me | 4-Cl | 4-Me | 4-Cl |
| 61 | 1 | 1 | 4-Pr | 4-Pr | 4-Pr | 4-Pr | 4-Pr | 4-Pr |
| 62 | 1 | 1 | 4-PhO | 4-PhO | 4-PhO | 4-PhO | 4-PhO | 4-PhO |
| 63 | 1 | 1 | H | 4-Me | H | 4-Me | H | 4-Me |
| 64 | 1 | 1 | $4\text{-}C_6H_5$ | $4\text{-}C_6H_5$ | $4\text{-}C_6H_5$ | $4\text{-}C_6H_5$ | $4\text{-}C_6H_5$ | $4\text{-}C_6H_5$ |

Abbreviations used in Example Compounds are as follows:
4-Me: a methyl group substituting the 4-position of the phenyl group
3-Me: a methyl group substituting the 3-position of the phenyl group
4-Cl: a chlorine atom substituting the 4-position of the phenyl group
4-MeO: a methoxy group substituting the 4-position of the phenyl group
4-F: a fluorine atom substituting the 4-position of the phenyl group
4-Pr: a propyl group substituting the 4-position of the phenyl group
4-PhO: a phenoxy group substituting the 4-position of the phenyl group The hole transporting materials represented by general formula (1) may be used alone or in combination. When a hole transporting material represented by general formula (1) is used, a hole transporting material other than the hole transporting materials represented by general formula (1) may be used in combination.

The amount of the hole transporting material other than the hole transporting materials represented by general formula (1) is, for example, 25% by weight or less relative to the total of the hole transporting materials.

The hole transporting material content relative to the total solid content of the photosensitive layer is 10% by weight or more and 40% by weight or less and may be 20% by weight or more and 35% by weight or less.

This hole transporting material content is the total hole transporting material content if two or more hole transporting materials are used in combination.

Electron Transporting Material

The electron transporting material may be any electron transporting material. Examples thereof include quinone compounds such as chloranil and bromanil; tetracyanoquinodimethane compounds; fluorenone compounds such as 2,4,7-trinitrofluorenone, octyl 9-dicyanomethylene-9-fluorenone-4-carboxylate, octyl 9-fluorenone-4-carboxylate, and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)1,3,4-oxadiazole; xanthone compounds; thiophene compounds; dinaphthoquinone compounds such as 3,3'-di-tert-pentyl-dinaphthoquinone; diphenoquinone compounds such as 3,3'-di-tert-butyl-5,5'-dimethyldiphenoquinone and 3,3',5,5'-tetra-tert-butyl-4,4'-diphenoquinon; and a polymer that has a group formed of any of the above-described compounds in a main chain or a side chain. These electron transporting materials may be used alone or in combination.

Among these, fluorenone compounds are preferable since sensitivity can be increased, for example. Among the fluorenone compounds, compounds represented by general formula (2) below are preferable. The electron transporting materials represented by general formula (2) are described below.

(2)

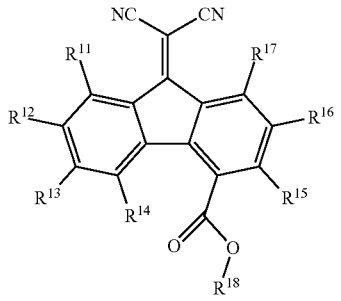

In general formula (2), $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group. $R^{18}$ represents an alkyl group, a group represented by $-L^{19}-O-R^{20}$, an aryl group, or an aralkyl group. Here, $L^{19}$ represents an alkylene group and $R^{20}$ represents an alkyl group.

Examples of the halogen atom represented by $R^{11}$ to $R^{17}$ in general formula (2) include a fluorine atom, a chlorine atom, a bromine atom, and an iodine atom.

Examples of the alkyl group represented by $R^{11}$ to $R^{17}$ in general formula (2) include linear or branched alkyl groups having 1 to 4 carbon atoms (or 1 to 3 carbon atoms). Specific examples thereof include a methyl group, an ethyl group, an n-propyl group, an isopropyl group, an n-butyl group, and an isobutyl group.

Examples of the alkoxy group represented by $R^{11}$ to $R^{17}$ in general formula (2) include alkoxy groups having 1 to 4 carbon atoms (or 1 to 3 carbon atoms). Specific examples thereof include a methoxy group, an ethoxy group, a propoxy group, and a butoxy group.

Examples of the aryl group represented by $R^{11}$ to $R^{17}$ in general formula (2) include a phenyl group and a tolyl group. The aryl group represented by $R^{11}$ to $R^{17}$ may be a phenyl group.

Examples of the aralkyl group represented by $R^{11}$ to $R^{17}$ in general formula (2) include a benzyl group, a phenethyl group, and a phenylpropyl group.

Examples of the alkyl group represented by $R^{18}$ in general formula (2) include linear alkyl groups having 1 to 12 carbon atoms (or 5 to 10 carbon atoms) and branched alkyl groups having 3 to 10 carbon atoms (or 5 to 10 carbon atoms).

Examples of the linear alky groups having 1 to 12 carbon atoms include a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, and an n-dodecyl group.

Examples of the branched alkyl groups having 3 to 10 carbon atoms include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

In the group represented by $-L^{19}-O-R^{20}$ represented by $R^{18}$ in general formula (2), $L^{19}$ represents an alkylene group and $R^{20}$ represents an alkyl group.

Examples of the alkylene group represented by $L^{19}$ include linear or branched alkylene groups having 1 to 12 carbon atoms, such as a methylene group, an ethylene group, an n-propylene group, an isopropylene group, an n-butylene group, an isobutylene group, a sec-butylene group, a tert-butylene group, an n-pentylene group, an isopentylene group, a neopentylene group, and a tert-pentylene group.

Examples of the alkyl group represented by $R^{20}$ include alkyl groups that are the same as those represented by $R^{11}$ to $R^{17}$ described above.

Examples of the aryl group represented by $R^{18}$ in general formula (2) include a phenyl group, a methylphenyl group, a dimethylphenyl group, and an ethylphenyl group.

The aryl group represented by $R^{18}$ may be an aryl group substituted with an alkyl group from the viewpoint of solubility. Examples of the alkyl group for the alkyl-substituted aryl group include the same groups as the alkyl groups represented by $R^{11}$ to $R^{17}$.

Examples of the aralkyl group represented by $R^{18}$ in general formula (2) include groups represented by $-L^{21}-Ar$, where $L^{21}$ represents an alkylene group and Ar represents an aryl group.

Examples of the alkylene group represented by $L^{21}$ include linear or branched alkylene groups having 1 to 12 carbon atoms. Examples thereof include a methylene group, an ethylene group, an n-propylene group, an isopropylene group, an n-butylene group, an isobutylene group, a sec-butylene group, a tert-butylene group, an n-pentylene group, an isopentylene group, a neopentylene group, and a tert-pentylene group.

Examples of the aryl group represented by Ar include a phenyl group, a methylphenyl group, a dimethylphenyl group, and an ethylphenyl group.

Specific examples of the aralkyl group represented by $R^{18}$ in general formula (2) include a benzyl group, a methylbenzyl group, a dimethylbenzyl group, a phenylethyl group, a methylphenylethyl group, a phenylpropyl group, and a phenylbutyl group.

To achieve high sensitivity and suppress color spots, the electron transporting material represented by general formula (2) may be an electron transporting material in which $R^{18}$ represents a branched alkyl group having 5 to 10 carbon atoms or an aralkyl group. For example, the electron transporting material may have $R^{11}$ to $R^{17}$ each independently representing a hydrogen atom, a halogen atom, or an alkyl group and $R^{18}$ representing a branched alkyl group having 5 to 10 carbon atoms or an aralkyl group.

Non-limiting Example Compounds of the electron transporting material represented by general formula (2) are as follows. In describing the reference numeral of Example Compound, the compound is described as "Example Compound (2-number). For example, Example Compound 15 is referred to as "Example Compound (2-15)".

| Example Compound | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|
| 1 | H | H | H | H | H | H | H | $-n-C_7H_{15}$ |
| 2 | H | H | H | H | H | H | H | $-n-C_8H_{17}$ |
| 3 | H | H | H | H | H | H | H | $-n-C_5H_{11}$ |
| 4 | H | H | H | H | H | H | H | $-n-C_{10}H_{21}$ |
| 5 | Cl | Cl | Cl | Cl | Cl | Cl | Cl | $-n-C_7H_{15}$ |
| 6 | H | Cl | H | Cl | H | Cl | Cl | $-n-C_7H_{15}$ |
| 7 | $CH_3$ | $CH_3$ | $CH_3$ | $CH_3$ | $CH_3$ | $CH_3$ | $CH_3$ | $-n-C_7H_{15}$ |
| 8 | $C_4H_9$ | $C_4H_9$ | $C_4H_9$ | $C_4H_9$ | $C_4H_9$ | $C_4H_9$ | $C_4H_9$ | $-n-C_7H_{15}$ |
| 9 | $CH_3O$ | H | $CH_3O$ | H | $CH_3O$ | H | $CH_3O$ | $-n-C_8H_{17}$ |
| 10 | $C_6H_5$ | $C_6H_5$ | $C_6H_5$ | $C_6H_5$ | $C_6H_5$ | $C_6H_5$ | $C_6H_5$ | $-n-C_8H_{17}$ |
| 11 | H | H | H | H | H | H | H | $-n-C_4H_9$ |
| 12 | H | H | H | H | H | H | H | $-n-C_{11}H_{23}$ |
| 13 | H | H | H | H | H | H | H | $-n-C_9H_{19}$ |
| 14 | H | H | H | H | H | H | H | $—CH_2—CH(C_2H_5)—C_4H_9$ |
| 15 | H | H | H | H | H | H | H | $—(CH_2)_2—Ph$ |
| 16 | H | H | H | H | H | H | H | $—CH_2—Ph$ |
| 17 | H | H | H | H | H | H | H | $-n-C_{12}H_{25}$ |
| 18 | H | H | H | H | H | H | H | $—C_2H_4—O—CH_3$ |

Abbreviations used in Example Compounds above are as follows:

Ph: a phenyl group

The electron transporting materials represented by general formula (2) may be used alone or in combination. When an electron transporting material represented by general formula (2) is used, an electron transporting material other than the electron transporting material represented by general formula (2) may be used in combination.

The amount of the electron transporting material other than the electron transporting material represented by general formula (2) may be 10% by weight or less with respect to the total of the electron transporting materials.

The electron transporting material content relative to the total solid content of the photosensitive layer is 4% by weight or more and 20% by weight or less or about 4% by weight or more and about 20% by weight or less and may be 6% by weight or more and 18% by weight or less or about 6% by weight or more and about 18% by weight or less.

When the electron transporting material content relative to the total solid content of the photoreceptor is within the above-described range, electrical properties of the photoreceptor are better compared to when the electron transporting material content is below the range and color spots (spot-shape image defects) are suppressed compared to when the electron transporting material content is beyond the range.

The electron transporting material content is the total of the electron transporting materials if two or more electron transporting materials are used in combination.

Ratio of Hole Transporting Material to Electron Transporting Material

The ratio of the hole transporting material to the electron transporting material on a weight basis (hole transporting material/electron transporting material) is 50/50 or more and 90/10 or less and may be 60/40 or more and 80/20 or less.

When other charge transporting materials are used in combination, the total thereof is used in calculating the ratio.

Other Additives

The single-layer-type photosensitive layer may further contain a surfactant, an antioxidant, a light stabilizer, a thermal stabilizer, and other known additives. When the single-layer-type photosensitive layer constitutes a surface layer, the single-layer-type photosensitive layer may contain fluororesin particles, a silicone oil, or the like.

Formation of Single-Layer-Type Photosensitive Layer

The single-layer-type photosensitive layer is formed by using a coating solution for forming a photosensitive layer, and this coating solution is prepared by adding the above-described components to a solvent.

Examples of the solvent are common organic solvents. Examples thereof include aromatic hydrocarbons such as benzene, toluene, xylene, and chlorobenzene; ketones such as acetone and 2-butanone, halogenated aliphatic hydrocarbons such as methylene chloride, chloroform, and ethylene chloride, and cyclic or linear ethers such as tetrahydrofuran and ethyl ether. These solvents are used alone or in combination.

In order to control the concentration ratio (A/B) to be in the range of 0.7 or more and 1.0 or less or about 0.7 or more and about 1.0 or less, the solvent may be tetrahydrofuran or a mixture of tetrahydrofuran and toluene.

When the solvent remains in the photosensitive layer of the electrophotographic photoreceptor, the solvent contained in the photosensitive layer is detected by qualitative and quantitative analyses such as gas chromatography. For example, a gas chromatograph (HP6890, produced by Agilent technologies) and columns (HP-5 ms, produced by Agilent technologies) are used at an initial oven temperature of 45° C.

In order to disperse particles (for example, charge generating material) in a coating solution for forming a photosensitive layer, a medium disperser such as a ball mill, a vibrating ball mill, an attritor, a sand mill, or a horizontal sand mill, or a medium-less disperser such as stirrer, an ultrasonic disperser, a roll mill, or a high-pressure homogenizer is used. Examples of the high-pressure homogenizer include collision-type homogenizers with which a dispersion is dispersed under a high pressure through liquid-liquid collision or liquid-wall collision, or a penetration-type homogenizer with which a material is caused to penetrate through narrow channels under a high pressure.

In order to control the concentration ratio (A/B) to 0.7 or more and 1.0 or less or about 0.7 or more and about 1.0 or less, the viscosity of the coating solution for forming a photosensitive layer is 290 mPa·s or more and 350 mPa·s or less (or may be 300 mPa·s or more and 330 mPa·s or less).

The viscosity of the coating solution for forming a photosensitive layer is, for example, measured with a cone-plate-type viscometer (RE-550 viscometer, produced by TOKI SANGYO CO., LTD.) in a measurement environment of 27.5° C.

Examples of the method for coating the undercoat layer with the coating solution for forming a photosensitive layer include a dip coating method, a lift coating method, a wire bar coating method, a spray coating method, a blade coating method, a knife coating method, and a curtain coating method.

In order to control the concentration ratio (A/B) to be in the range of 0.7 or more and 1.0, for example, various conditions are combined. The conditions include the type of the binder resin, the viscosity-average molecular weight of the binder resin, the difference in SP value between the binder resin and the electron transporting material, the viscosity of the coating solution for forming a photosensitive layer, and conditions for drying a coating film prepared by applying the coating solution for forming a photosensitive layer.

The conditions for drying the coating film prepared by using the coating solution for forming a photosensitive layer may be as follows in order to control the concentration ratio (A/B) to be in the range of 0.7 or more and 1.0 or less or about 0.7 or more and about 1.0 or less. That is, for example, the drying temperature is 130° C. or higher and 150° C. or lower and the drying time is 35 minutes or longer and 50 minutes or shorter.

The thickness of the single-layer-type photosensitive layer may be 5 μm or more and 60 μm or less, may be 5 μm or more and 50 μm or less, or may be 10 μm or more and 40 μm or less.

Other Layers

The photoreceptor according to the exemplary embodiment may further include another layer if needed, as described above. An example of this another layer is a protective layer that constitutes the outermost surface layer on the photosensitive layer. The protective layer is provided to prevent chemical changes in the photosensitive layer during charging or further improve the mechanical strength of the photosensitive layer, for example. To serve these purposes, the protective layer may be a layer formed of a cured film (crosslinked film). Examples of such a layer include the layers 1) and 2) below.

1) A layer formed of a cured film prepared from a composition that contains a reactive-group-containing charge transporting material in which a reactive group and a charge transporting skeleton are contained in the same molecule (in other words, a layer that contains a polymer or crosslinked product of the reactive-group-containing charge transporting material); and 2) A layer formed of a cured film prepared from a composition containing an unreactive charge transporting material and a reactive-group-containing non-charge transporting material that has no charge transporting skeleton (in other words, a layer that contains a polymer or crosslinked product of the unreactive charge transporting material and the reactive-group-containing non-charge transporting material).

Examples of the reactive group of the reactive-group-containing charge transporting material include known reactive groups such as a chain polymerizable group, an epoxy group, —OH, —OR [where R represents an alkyl group], —$NH_2$, —SH, —COOH, and —$SiR^{Q1}_{3-Qn}(OR^{Q2})_{Qn}$ [where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3].

The chain polymerizable group may be any functional group that is radically polymerizable. An example is a functional group having at least a carbon-carbon double bond. A specific example thereof is a group that contains at least one group selected from a vinyl group, a vinyl ether group, a vinyl thioether group, a vinylphenyl group, a styryl group, an acryloyl group, a methacryloyl group, and derivatives of the foregoing. The chain polymerizable group may be a group that contains at least one group selected from a vinyl group, a vinylphenyl group, a styryl group, an acryloyl group, a methacryloyl group, and derivatives of the foregoing.

The charge transporting skeleton of the reactive-group-containing charge transporting material may be any known structure for electrophotographic photoreceptors. An example thereof is a structure having a skeleton derived from a nitrogen-containing hole transporting compound such as a triarylamine compound, a benzidine compound, or a hydrazine compound, and being conjugated with a nitrogen atom. A triarylamine skeleton may be used as the skeleton.

The reactive-group-containing charge transporting material that has a reactive group and a charge transporting skeleton, the non-reactive charge transporting material, and the reactive-group-containing non-charge transporting material may be selected from known materials.

The protective layer may further contain known additives.

The protective layer may be formed by any known method. For example, the components described above may be added to a solvent to prepare a coating solution for forming a protective layer, the coating solution may be applied to form a film, and the film may be dried and, if needed, heated, to perform curing.

Examples of the solvent used to prepare the coating solution for forming a protective layer include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. These solvents may be used alone or in combination.

The coating solution for forming a protective layer may be a solvent-less coating solution.

Examples of the method for applying the coating solution for forming a protective layer to the photosensitive layer include common methods such as a dip coating method, a lift coating method, a wire bar coating method, a spray coating method, a blade coating method, a knife coating method, and a curtain coating method.

The thickness of the protective layer is, for example 1 μm or more and 20 μm or less or may be 2 μm or more and 10 μm or less.

Image Forming Apparatus (and Process Cartridge)

An image forming apparatus according to an exemplary embodiment includes an electrophotographic photoreceptor, a charging unit that charges a surface of the electrophotographic photoreceptor, an electrostatic latent image forming unit that forms an electrostatic latent image on the charged surface of the electrophotographic photoreceptor, a developing unit that develops the electrostatic latent image on the surface of the electrophotographic photoreceptor with a developer containing a toner so as to form a toner image, and a transfer unit that transfers the toner image onto a surface of a recording medium. The electrophotographic photoreceptor of the aforementioned exemplary embodiment is used as the electrophotographic photoreceptor.

The image forming apparatus of this exemplary embodiment is applicable to commonly used image forming apparatuses such as follows: an apparatus equipped with a fixing unit that fixes the toner image transferred onto the surface of the recording medium; a direct-transfer-type apparatus that directly transfers the toner image formed on the surface of the electrophotographic photoreceptor onto the recording medium; an intermediate-transfer-type apparatus that transfers the toner image formed on the surface of the electrophotographic photoreceptor onto a surface of an intermediate transfer body (first transfer) and then transfers the toner image on the surface of the intermediate transfer body onto a surface of the recording medium (second transfer); an apparatus equipped with a cleaning unit that cleans the surface of the electrophotographic photoreceptor after the transfer of the toner image and before charging; an apparatus equipped with a charge erasing unit that applies charge erasing light onto the surface of the image-supporting member after the transfer of the toner image and before charging; and an apparatus equipped with a member that heats the electrophotographic photoreceptor in order to increase the temperature of the electrophotographic photoreceptor and decrease the relative temperature.

According to the intermediate-transfer-type apparatus, the transfer unit includes an intermediate transfer body having a surface onto which a toner image is transferred, a first transfer unit that transfers the toner image on the surface of the image-supporting member onto a surface of the intermediate transfer body, and a second transfer unit that transfers the toner image on the surface of the intermediate transfer body onto a surface of a recording medium.

The image forming apparatus of this exemplary embodiment may be a dry-development type image forming apparatus or a wet-development type image forming apparatus (development is conducted by using a liquid developer).

In the image forming apparatus of this exemplary embodiment, for example, the portion equipped with an electrophotographic photoreceptor may have a cartridge structure (process cartridge) detachably attachable to the image forming apparatus. An example of the process cartridge is a process cartridge that includes the electrophotographic photoreceptor of the exemplary embodiment. The process cartridge may include, in addition to the electrophotographic photoreceptor, at least one selected from the group consisting of a charging unit, an electrostatic latent image forming unit, a developing unit, and a transfer unit.

A non-limiting example of the image forming apparatus of the exemplary embodiment is described below. The components illustrated in the drawings are described, and the descriptions of other components not illustrated in the drawings are omitted.

Figure 2:
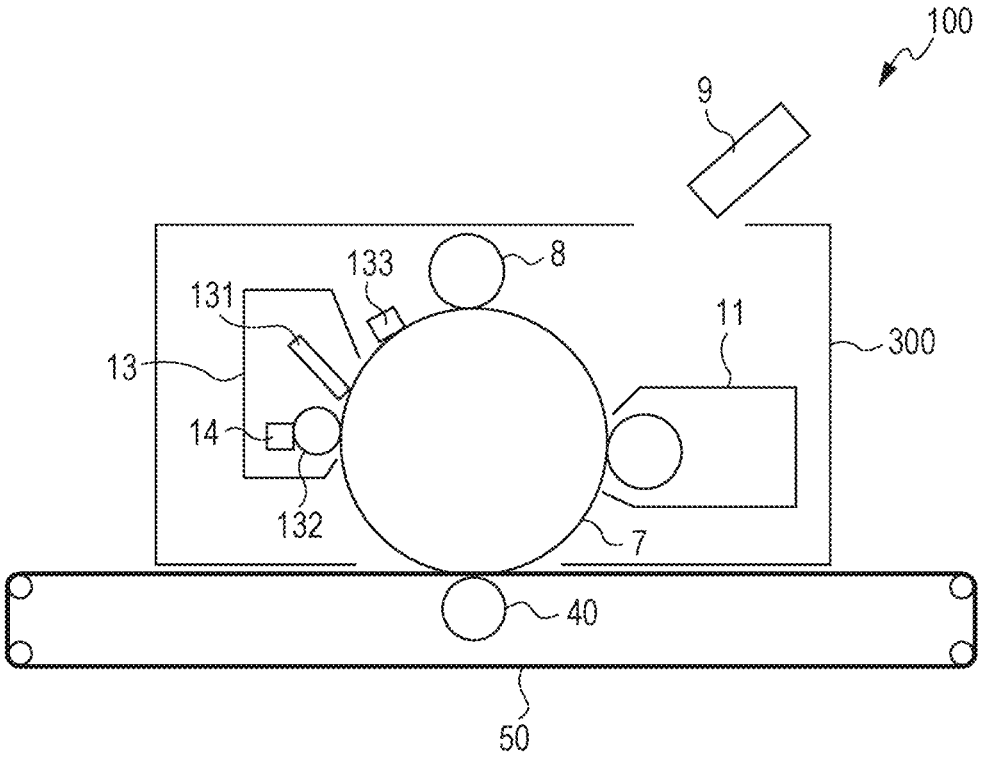
FIG. 2 is a schematic diagram illustrating an image forming apparatus according to an exemplary embodiment.

FIG. 2 is a schematic diagram illustrating an example of the image forming apparatus of the exemplary embodiment. Referring to FIG. 2, an image forming apparatus 100 of the exemplary embodiment includes a process cartridge 300 that includes an electrophotographic photoreceptor 7, an exposing device 9 (an example of an electrostatic latent image forming unit), a transfer device 40 (first transfer device), and an intermediate transfer body 50. In the image forming apparatus 100, the exposing device 9 is located at a position such that the exposing device 9 applies light to the electrophotographic photoreceptor 7 through an opening in the process cartridge 300. The transfer device 40 is located at a position such that the transfer device 40 opposes the electrophotographic photoreceptor 7 with the intermediate transfer body 50 therebetween. The intermediate transfer body 50 is arranged so that a part of the intermediate transfer member 50 contacts the electrophotographic photoreceptor 7. Although not illustrated in the drawing, a second transfer device that transfers the toner image on the intermediate transfer body 50 onto a recording medium (for example, paper sheet) is also provided. The intermediate transfer body 50, the transfer device 40 (first transfer device), and the second transfer device (not illustrated in the drawing) correspond to examples of the transfer unit.

The process cartridge 300 illustrated in FIG. 2 integrally supports the electrophotographic photoreceptor 7, a charging device 8 (an example of a charging unit), a developing device 11 (an example of a developing unit), and a cleaning device 13 (an example of a cleaning unit) in the housing. The cleaning device 13 includes a cleaning blade (an example of a cleaning member) 131, and the cleaning blade 131 is arranged to make contact with a surface of the electrophotographic photoreceptor 7. The cleaning member may be a conductive or insulating fibrous member instead of the cleaning blade 131. The conductive or insulating fibrous member may be used alone or in combination with the cleaning blade 131.

FIG. 2 illustrates an example of the image forming apparatus that includes a fibrous member 132 (roll shape) that supplies a lubricant 14 onto the surface of the electrophotographic photoreceptor 7, and a fibrous member 133 (flat brush shape) that assists cleaning. These parts are arranged as needed.

Individual components of the image forming apparatus of the exemplary embodiment will now be described.

Charging Device

Examples of the charging device 8 include contact-type chargers that use conductive or semi-conductive charging rollers, charging brushes, charging films, charging rubber blades, and charging tubes; and non-contact-type chargers known in the art such as non-contact-type roller chargers and scorotron chargers and corotron chargers that use corona discharge.

Exposing Device

An example of the exposing device 9 is an optical device that illuminates the surface of the electrophotographic photoreceptor 7 by light from a semiconductor laser, an LED, or a liquid crystal shutter so as to form an intended light image on the surface. The wavelength of the light source is to be within the region of the spectral sensitivity of the electrophotographic photoreceptor. The mainstream semiconductor lasers are infrared lasers having an oscillation wavelength around 780 nm. The wavelength is not limited to this, and a laser that has an oscillation wavelength on the order of 600 nm or a blue laser that has an oscillation wavelength of 400 nm or more and 450 nm or less may also be used. A surface-emission type laser light source capable of outputting a multibeam is effective for forming color images.

Developing Device

An example of the developing device 11 is a typical developing device that conducts development by using a developer in a contact or non-contact manner. The developing device 11 may be any device that has this function and is selected according to the purpose. An example thereof is a known developing device that has a function of causing a one-component or two-component developer to attach to the electrophotographic photoreceptor 7 by using a brush, a roller, or the like. In particular, the developing device may use a development roller that retains the developer on the surface thereof.

The developer used in the developing device 11 may be a one-component developer formed of a toner alone or may be a two-component developer formed of a toner and a carrier. The developer may be magnetic or non-magnetic. Known developers may be used as the developer.

Cleaning Device

A cleaning blade-type device equipped with the cleaning blade 131 is used as the cleaning device 13. A fur brush cleaning technique or a technique of performing development and cleaning simultaneously may be employed instead of or in addition to the cleaning blade.

Transfer Device

Examples of the transfer device 40 include contact-type transfer chargers that use belts, rollers, films, rubber blades, etc., and scorotron transfer chargers and corotron transfer chargers that use corona discharge known in the art.

Intermediate Transfer Body

The intermediate transfer body 50 may be a belt-shaped member (intermediate transfer belt) that contains a polyimide, a polyamideimide, a polycarbonate, a polyarylate, a polyester, rubber, or the like that is made semi-conductive. The intermediate transfer body may have a drum shape instead of the belt shape.

Figure 3:
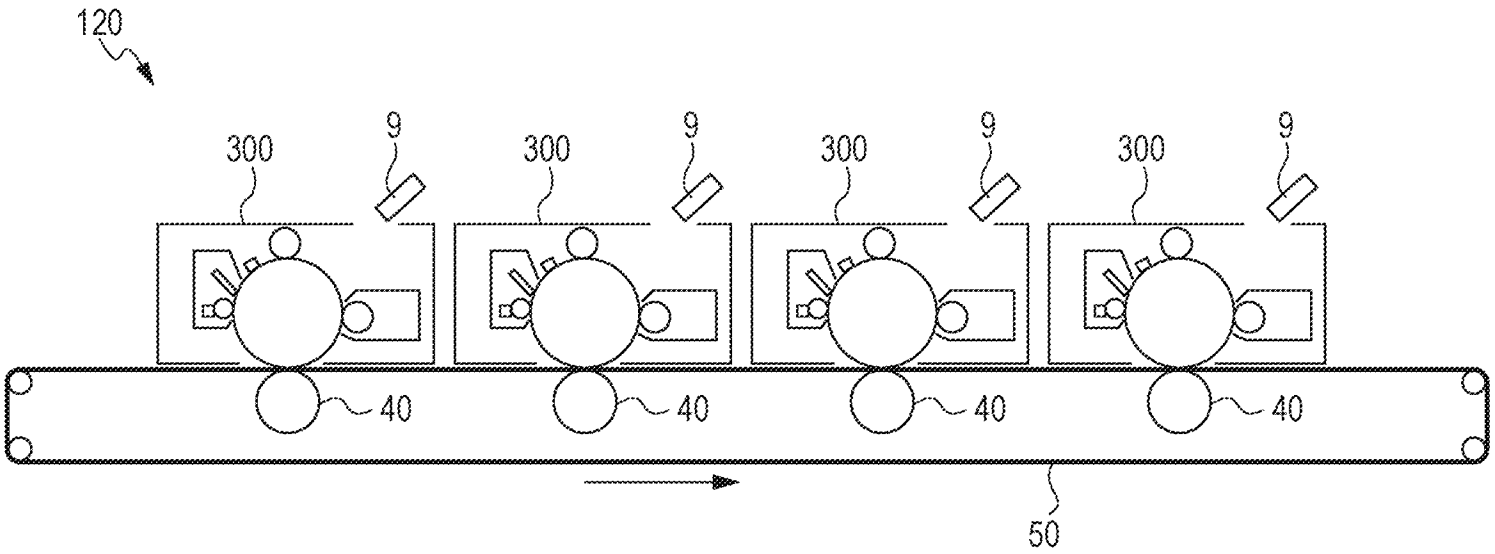
FIG. 3 is a schematic diagram illustrating an image forming apparatus according to another exemplary embodiment.

FIG. 3 is a schematic diagram illustrating another example of the image forming apparatus of the exemplary embodiment. An image forming apparatus 120 illustrated in FIG. 3 is a multi-color image forming apparatus of a tandem-type equipped with four process cartridges 300. In the image forming apparatus 120, four process cartridges 300 are arranged side-by-side on the intermediate transfer body 50. One electrophotographic photoreceptor is used for one color. The image forming apparatus 120 has the same structure as the image forming apparatus 100 except for that the image forming apparatus 120 is of a tandem type.

The structure of the image forming apparatus 100 is not limited to one described above. For example, a first charge erasing device that makes the polarity of the residual toner uniform so that the residual toner may be easily removed may be provided around the electrophotographic photoreceptor 7, on the downstream side of the transfer device 40 in the electrophotographic photoreceptor 7 rotation direction and on the upstream side of the cleaning device 13 in the electrophotographic photoreceptor rotating direction. Alternatively, a second charge erasing device that erases charges from the surface of the electrophotographic photoreceptor 7 may be provided on the downstream side of the cleaning device 13 in the electrophotographic photoreceptor rotating direction and on the upstream side of the charging device 8 in the electrophotographic photoreceptor rotating direction.

The structure of the image forming apparatus 100 is not limited to one described above and may be, for example, any known direct-transfer-type image forming apparatus that directly transfers a toner image on the electrophotographic photoreceptor 7 onto a recording medium.

EXAMPLES

The present invention will now be specifically described by using examples and comparative examples which do not limit the scope of the invention. In the descriptions below, "parts" means parts by weight and "%" means "% by weight" unless otherwise noted.

Example 1

Formation of a Photosensitive Layer

A mixture containing 1.5 parts by weight of a hydroxygallium phthalocyanine pigment indicated in Table serving as the charge generating material, 54.5 parts by weight of a bisphenol Z polycarbonate resin (viscosity average molecular weight: 50,000) serving as the binder resin, 18 parts by weight of an electron transporting material indicated in Table serving as the electron transporting material, 36 parts by weight of a hole transporting material indicated in Table serving as the hole transporting material, and 250 parts by weight of tetrahydrofuran serving as a solvent is dispersed for 4 hours in a sand mill along with glass beads having a diameter of 1 mm. As a result, a coating solution for forming a photosensitive layer (viscosity: 310 mPa·s) is obtained.

The obtained coating solution for forming a photosensitive layer is applied to an aluminum substrate having a diameter f 30 mm, a length of 244.5 mm, and a thickness of 1 mm by a dip coating method. The applied solution is dried and cured at 135° C. for 35 minutes. As a result, a single-layer-type photosensitive layer having a thickness of 30 μm is obtained. An electrophotographic photoreceptor is obtained through the above-described steps.

Examples 2 to 11 and Comparative Examples 1 to 8

Electrophotographic photoreceptors are prepared as in Example 1 except that the type of the binder resin, the type of the electron transporting material, the type of the hole transporting material, the type of the charge generating material, and the drying conditions are changed as described in Table. When the amount of each component is changed, the amount (parts) of the binder resin is adjusted so that the solid content of the photosensitive layer is 100 parts by weight.

Evaluation

The electrophotographic photoreceptors are evaluated as follows. The results are indicated in Table.

Evaluation of Concentration Ratio

Measurement is conducted as described above and (A/B) is calculated.

Color Spots Evaluation

A modified HL5340D produced by Brother Industries Ltd., equipped with a photoreceptor is used to conduct evaluation of color sports. In a high-temperature, high-humidity environment at a temperature of 28° C. and a relative humidity (RH) of 85%, a 50% halftone image is printed on 2000 sheets at a charge voltage of +800 V. Operation of the machine is stopped overnight, and a blank paper sheet is fed through the machine next morning. The number of color spots on the paper sheet is counted and the evaluation is made according to the following standards.

A: No color spots are found.

B: One to nine color spots are found.

C: Ten or more color spots are found.

Evaluation of Sensitivity of Photoreceptor

The sensitivity of the photoreceptor is evaluated as a half decay exposure after being charged to +800 V. Specifically, an electrostatic paper analyzer (EPA-8100 produced by Kawaguchi Electric Works Co., Ltd.) is used to charge the photoreceptor to +800 V in a 20° C., 40% RH environment. Then 800 nm monochromatic light obtained from a tungsten lamp through a monochromator is applied to the photoreceptor so that the quantity of light is 1 μW/cm$^2$ on the surface of the photoreceptor. The surface potential Vo (V) of the surface of the photoreceptor immediately after charging and the half decay exposure E1/2 (μJ/cm$^2$) at which the surface potential reaches 1/2×Vo (V) by irradiation of the photoreceptor surface is measured. The evaluation standards are as follows.

A: The half decay exposure is 0.15 μJ/cm$^2$ or less.

B: The half decay exposure is more than 0.15 μJ/cm$^2$ but not more than 0.18 μJ/cm$^2$.

C: The half decay exposure is more than 0.18 μJ/cm$^2$ but not more than 0.20 μJ/cm$^2$.

D: The half decay exposure is more than 0.20 μJ/cm$^2$.

TABLE

| | Binder | Charge generating material | | Hole transporting material | | Electron transporting material | | Viscosity of coating | Drying | Drying | Concentration | | |
|---|---|---|---|---|---|---|---|---|---|---|---|---|---|
| | resin Type | Type | Parts by weight | Type | Parts by weight | Type | Parts by weight | solution mPa · s | temperature ° C. | time Min | ratio A/B | Color spots | Sensitivity |
| Example 1 | Binder 1 | CGM1 | 1.5 | HTM1 | 36 | ETM1 | 18 | 310 | 135 | 35 | 0.77 | A | A |
| Example 2 | Binder 2 | CGM1 | 1.5 | HTM1 | 36 | ETM1 | 18 | 322 | 135 | 35 | 0.78 | A | A |
| Example 3 | Binder 1 | CGM2 | 1.5 | HTM1 | 36 | ETM1 | 18 | 314 | 135 | 35 | 0.77 | A | B |
| Example 4 | Binder 1 | CGM3 | 1.5 | HTM1 | 36 | ETM1 | 18 | 309 | 135 | 35 | 0.77 | A | C |
| Example 5 | Binder 1 | CGM1 | 1.5 | HTM2 | 36 | ETM1 | 18 | 303 | 135 | 35 | 0.73 | A | B |
| Example 6 | Binder 1 | CGM1 | 1.5 | HTM3 | 36 | ETM1 | 18 | 319 | 135 | 35 | 0.78 | A | C |
| Example 7 | Binder 1 | CGM1 | 1.5 | HTM4 | 36 | ETM1 | 18 | 311 | 135 | 35 | 0.77 | A | C |
| Example 8 | Binder 1 | CGM1 | 1.5 | HTM1 | 36 | ETM2 | 18 | 301 | 135 | 35 | 0.73 | A | B |
| Example 9 | Binder 1 | CGM1 | 1.5 | HTM1 | 36 | ETM3 | 18 | 328 | 135 | 35 | 0.81 | A | B |
| Example 10 | Binder 1 | CGM1 | 1.5 | HTM1 | 36 | ETM4 | 18 | 325 | 135 | 35 | 0.78 | A | D |
| Example 11 | Binder 1 | CGM1 | 1.5 | HTM1 | 36 | ETM5 | 18 | 314 | 135 | 35 | 0.77 | A | D |
| Comparative Example 1 | Binder 3 | CGM1 | 1.5 | HTM1 | 36 | ETM1 | 18 | 279 | 135 | 35 | 0.63 | B | A |
| Comparative Example 2 | Binder 4 | CGM1 | 1.5 | HTM1 | 36 | ETM1 | 18 | 244 | 135 | 35 | 0.54 | C | A |

TABLE-continued

| | Binder | Charge generating material | | Hole transporting material | | Electron transporting material | | Viscosity of coating | Drying | Drying | Concentration | | |
|---|---|---|---|---|---|---|---|---|---|---|---|---|---|
| | resin Type | Type | Parts by weight | Type | Parts by weight | Type | Parts by weight | solution mPa · s | temperature ° C. | time Min | ratio A/B | Color spots | Sensitivity |
| Comparative Example 3 | Binder 1 | CGM1 | 1.5 | HTM1 | 36 | ETM1 | 18 | 275 | 135 | 35 | 0.66 | B | A |
| Comparative Example 4 | Binder 1 | CGM1 | 1.5 | HTM1 | 36 | ETM1 | 18 | 245 | 135 | 35 | 0.57 | C | A |
| Comparative Example 5 | Binder 1 | CGM1 | 1.5 | HTM1 | 36 | ETM1 | 18 | 312 | 135 | 30 | 0.60 | B | A |
| Comparative Example 6 | Binder 1 | CGM1 | 1.5 | HTM1 | 36 | ETM1 | 18 | 311 | 135 | 20 | 0.55 | C | A |
| Comparative Example 7 | Binder 1 | CGM1 | 1.5 | HTM1 | 36 | ETM1 | 18 | 308 | 123 | 35 | 0.59 | C | A |
| Comparative Example 8 | Binder 1 | CGM1 | 1.5 | HTM1 | 36 | ETM1 | 18 | 309 | 113 | 35 | 0.45 | C | A |

The results demonstrate that Examples have fewer color spots than Comparative Examples.

Details of the abbreviations used in Table are as follows.

Charge Generating Material

CGM1 (HOGaPC): hydroxygallium phthalocyanine (V-type): A V-type hydroxygallium phthalocyanine pigment having diffraction peaks at Bragg's angles (2θ±0.2°) of at least 7.3°, 16.0°, 24.9°, and 28.0° in an X-ray diffraction spectrum taken with a Cu Kα X-ray (in an absorption spectrum in a wavelength range of 600 nm or more and 900 nm or less, the maximum peak wavelength=820 nm, average particle diameter=0.12 μm, maximum particle diameter=0.2 μm, specific surface area=60 $m^2/g$)

CGM2 (ClGaPC): chlorogallium phthalocyanine: A chlorogallium phthalocyanine pigment having diffraction peaks at Bragg's angles (2θ±0.2°) of at least 7.4°, 16.6°, 25.5°, and 28.3° in an X-ray diffraction spectrum taken with a Cu Kα X-ray (in an absorption spectrum in a wavelength of 600 nm or more and 900 nm or less, the maximum peak wavelength=780 nm, average particle diameter=0.15 μm, maximum particle diameter=0.2 μm, specific surface area=56 $m^2/g$)

CGM3 (H2PC): X-type metal-free phthalocyanine pigment (a phthalocyanine having two hydrogen atoms coordinated to the center of the phthalocyanine skeleton)

Hole Transporting Material

HTM1: Example Compound (1-1) of the hole transporting material represented by general formula (1)

HTM2: Example Compound (1-41) of the hole transporting material represented by general formula (1)

HTM3: hole transporting material HTM3 having the structure below

HTM4: hole transporting material HTM4 having the structure below (N,N'-diphenyl-N,N'-bis(3-methylphenyl)-[1,1']biphenyl-4,4'-diamine)

HTM3

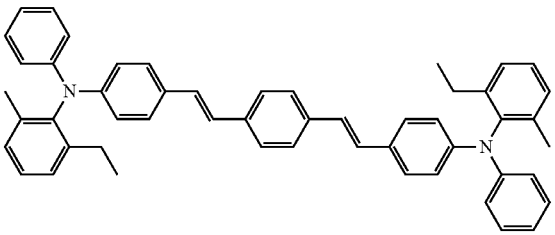

HTM4

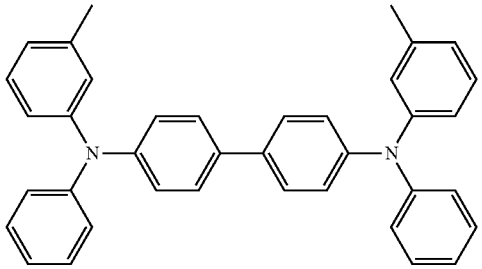

Electron Transporting Material

ETM1: Example Compound (2-14) of the electron transporting material represented by general formula (2)

ETM2: Example Compound (2-2) of the electron transporting material represented by general formula (2)

ETM3: Example Compound (2-11) of the electron transporting material represented by general formula (2)

ETM4: electron transporting material ETM4 having the structure below 3,3',5,5'-tetra-tert-butyl-4,4'-diphenoquinone ETM5: electron transporting material ETM5 having the structure below (3,3'-di-tert-pentyl-dinaphthoquinone)

ETM4

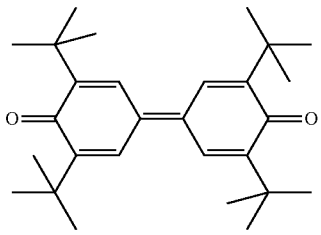

ETM5

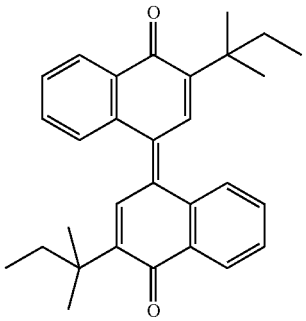

Binder Resin

Binder 1: bisphenol Z polycarbonate resin (viscosity-average molecular weight: 50,000)

Binder 2: bisphenol Z polycarbonate/biphenyl copolymer resin (viscosity-average molecular weight: 50,000)

Binder 3: bisphenol C polycarbonate resin (viscosity-average molecular weight: 50,000)

Binder 4: bisphenol Z polycarbonate resin (viscosity-average molecular weight: 30,000)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a single-layer-type photosensitive layer on the conductive substrate, the single-layer-type photosensitive layer containing a binder resin, a charge generating material, an electron transporting material, and a hole transporting material, wherein the single-layer-type photosensitive layer has a concentration ratio (A/B) of about 0.7 or more and about 1.0 or less, where the concentration ratio (A/B) is a ratio of a concentration A of the electron transporting material relative to the binder resin measured from a surface of the photosensitive layer remote from the conductive substrate to a concentration B of the electron transporting material relative to the binder resin measured from a surface of the photosensitive layer close to the conductive substrate.

2. The electrophotographic photoreceptor according to claim 1, wherein a binder resin content relative to a total solid content of the photosensitive layer is about 35% by weight or more and about 60% by weight or less.

3. The electrophotographic photoreceptor according to claim 1, wherein a binder resin content relative to a total solid content of the photosensitive layer is about 20% by weight or more and about 35% by weight or less.

4. The electrophotographic photoreceptor according to claim 1, wherein an electron transporting material content relative to a total solid content of the photosensitive layer is about 4% by weight or more and about 20% by weight or less.

5. The electrophotographic photoreceptor according to claim 1, wherein an electron transporting material content relative to a total solid content of the photosensitive layer is about 6% by weight or more and about 18% by weight or less.

6. The electrophotographic photoreceptor according to claim 1, wherein the charge generating material is at least one pigment selected from a hydroxygallium phthalocyanine pigment and a chlorogallium phthalocyanine pigment.

7. The electrophotographic photoreceptor according to claim 1, wherein the hole transporting material is a hole transporting material represented by general formula (1) below:

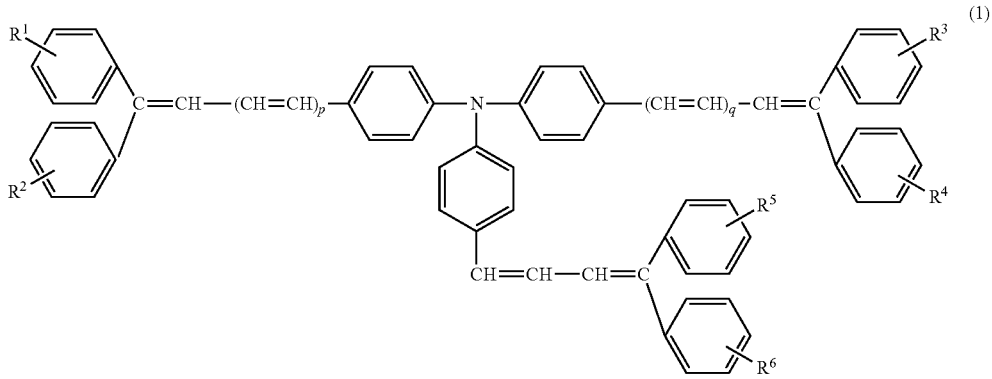

(1)

(where $R^1$, $R^2$, $R^3$, $R^4$, $R^5$, and $R^6$ each independently represent a hydrogen atom, a lower alkyl group, an alkoxy group, a phenoxy group, a halogen atom, or a phenyl group which may have a substituent selected from a lower alkyl group, a lower alkoxy group, and a halogen atom; and p and q each independently represent 0 or 1).

8. The electrophotographic photoreceptor according to claim 1, wherein the electron transporting material is an electron transporting material represented by general formula (2) below:

(2)

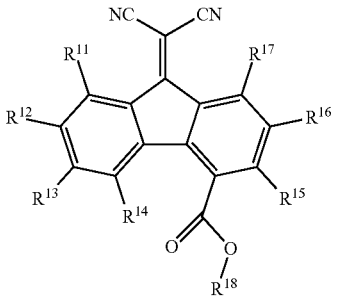

(where $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group; and $R^{18}$ represents an alkyl group, a group represented by $-L^{19}-O-R^{20}$, an aryl group, or an aralkyl group, where $L^{19}$ represents an alkylene group and $R^{20}$ represents an alkyl group).

9. A process cartridge removably attachable to an image forming apparatus, comprising the electrophotographic photoreceptor according to claim 1.

10. An image forming apparatus comprising:

the electrophotographic photoreceptor according to claim 1;

a charging unit that charges a surface of the electrophotographic photoreceptor;

an electrostatic latent image forming unit that forms an electrostatic latent image on the charged surface of the electrophotographic photoreceptor;

a developing unit that develops the electrostatic latent image on the surface of the electrophotographic photoreceptor with a developer that contains a toner so as to form a toner image; and a transfer unit that transfers the toner image onto a surface of a recording medium.

* * * * *